US011674307B2

(12) United States Patent
Khatri et al.

(10) Patent No.: US 11,674,307 B2
(45) Date of Patent: Jun. 13, 2023

(54) MODULAR NON-METALLIC PARTITIONS

(71) Applicant: Saudi Arabian Oil Company, Dhahran (SA)

(72) Inventors: Waseem Khatri, Dhahran (SA); Mazin Menkabo, Al Khobar (SA); Oscar Salazar, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/507,311

(22) Filed: Oct. 21, 2021

(65) Prior Publication Data

US 2023/0126903 A1 Apr. 27, 2023

(51) Int. Cl.
*E04B 2/74* (2006.01)
*E04B 2/82* (2006.01)

(52) U.S. Cl.
CPC ..... *E04B 2/7425* (2013.01); *E04B 2/82* (2013.01); *E04B 2/828* (2013.01); *E04B 2002/7461* (2013.01); *E04B 2002/7462* (2013.01)

(58) Field of Classification Search
CPC .. E04B 2/7425; E04B 2002/7461; E04B 2/82; E04B 2/828; E04B 2002/7462
USPC .... 52/238.1, 235, 481.2, 202, 217; 160/372; 256/67; 248/354.1
See application file for complete search history.

(56) References Cited

U.S. PATENT DOCUMENTS 4,127,196 A * 11/1978 Boucher ..... A47F 5/0815 52/645
4,731,961 A * 3/1988 Bona ..... E04H 1/1277 52/63
4,905,428 A * 3/1990 Sykes ..... E04B 2/745 52/270
5,125,202 A * 6/1992 Kissinger ..... E05D 13/04 49/404
5,433,046 A * 7/1995 MacQuarrie ..... E04B 2/7422 52/240

(Continued)

OTHER PUBLICATIONS epiplastics.com [online], "Demountable PVC Wall System," Extrutech Plastics, Inc., available on or before Jan. 2021 via Internet Archive Wayback Machine URL <https://web.archive.org/web/20210120141329/https://epiplastics.com/wp-content/uploads/demountable-wall-system.pdf>, retrieved on Aug. 13, 2021, retrieved from URL <https://epiplastics.com/wp-content/uploads/demountable-wall-system.pdf>, 2 pages.

(Continued)

*Primary Examiner* — Brent W Herring
(74) *Attorney, Agent, or Firm* — Fish & Richardson P.C.

(57) ABSTRACT

A modular partition system includes a non-metallic polymer frame assembly. Horizontal members of frame sub-assemblies of the frame assembly are slidably engaged such that a width of a rectangular opening of the frame assembly can be adjusted by sliding the first frame sub-assembly and the second frame sub-assembly together or apart. Front surfaces of the frame sub-assemblies include notches on their front surfaces. The system also includes a non-metallic rectangular polymer panels with non-metallic pegs. If the width of the rectangular opening is adjusted to a specified width, the notches and the pegs align and the pegs can insert into the notches, thereby attaching the panel to the frame assembly.

13 Claims, 6 Drawing Sheets

(56) References Cited

U.S. PATENT DOCUMENTS 5,636,484 A * 6/1997 DeBlock ..... E06B 3/5892 52/204.5
5,735,100 A * 4/1998 Campbell ..... E04B 5/14 52/745.11
5,787,665 A 8/1998 Carlin et al.
5,822,940 A 10/1998 Carlin et al.
5,927,038 A * 7/1999 Goldberg ..... E04B 2/821 52/645
6,138,993 A * 10/2000 Mitchell, Jr. ..... E04H 17/163 256/25
6,253,516 B1 7/2001 D'Andrea et al.
7,797,897 B2 9/2010 Roth
8,127,508 B2 * 3/2012 Muhlebach ..... E04G 21/243 52/657
8,322,102 B2 12/2012 Krieger
8,596,015 B2 * 12/2013 Coon ..... E05B 73/00 52/645
8,931,753 B2 * 1/2015 Sollars ..... E04G 17/00 249/194
10,041,243 B2 8/2018 Walker
10,233,635 B2 * 3/2019 Vehniainen ..... E04B 2/821
10,458,663 B2 * 10/2019 Meng ..... F24F 1/58
2004/0020137 A1 * 2/2004 Battey ..... E04B 2/7425 52/220.7
2005/0284059 A1 * 12/2005 Rerup ..... E01F 8/0011 52/306
2006/0059815 A1 * 3/2006 Bergareche ..... E04G 9/05 52/309.17
2011/0278432 A1 * 11/2011 Sollars ..... E04G 9/08 249/189
2012/0167523 A1 * 7/2012 Krieger ..... E04B 2/7453 52/775
2013/0112356 A1 5/2013 Matthews
2013/0139467 A1 * 6/2013 Thompson ..... E06B 3/5892 52/656.5
2016/0083965 A1 * 3/2016 Baert ..... B29C 65/4805 52/309.1
2020/0071931 A1 3/2020 Marandos et al.

OTHER PUBLICATIONS infocenter.com [online], "Snap Fits Best Practices," available on or before 2021, retrieved Dec. 8, 2021, retrieved from URL <https://infocenter.3dsystems.com/bestpractices/mjp-best-practices/projet-mjp-2500/rapid-prototyping/snap-fits>, 9 pages.

* cited by examiner

MODULAR NON-METALLIC PARTITIONS

TECHNICAL FIELD

This disclosure relates generally to modular non-metallic partitions for dwellings or other buildings.

BACKGROUND

It is frequently necessary to install partitions in dwellings, workplaces, and other built spaces to separate one area from another within the space. It can be desirable for such partitions to be modular and pre-fabricated, with flexibility and choice in terms of composition, size, shape, finish, and other features. It can further be desirable for such partitions to have flame resistance and noise reduction qualities.

SUMMARY

Certain aspects of the subject matter herein can be implemented as a modular partition system. The system includes a non-metallic polymer frame assembly forming a substantially rectangular opening. The opening is defined by a vertical member of a first frame sub-assembly, a vertical member of a second frame sub-assembly, a top horizontal member of the first frame sub-assembly, a bottom horizontal member of the first frame sub-assembly, a top horizontal member of the second frame sub-assembly, and a bottom horizontal member of the second frame sub-assembly. The top horizontal member of the first frame sub-assembly and the bottom horizontal member of the second frame subassembly are slidably engaged with the top horizontal member of the second frame sub-assembly and the bottom horizontal member of the second frame sub-assembly, respectively, such that a width of the rectangular opening can be adjusted by sliding the first frame sub-assembly and the second frame sub-assembly together or apart. A front surface of the first frame sub-assembly includes a first notch and a front surface of the second frame sub-assembly includes a second notch. The system also includes a non-metallic rectangular polymer panel comprising a front panel surface and a back panel surface. A plurality of non-metallic pegs protrude from the back panel surface. If the width of the rectangular opening is adjusted to a specified width, the first notch is aligned with a first one of the plurality of pegs and the second notch is aligned with a second one of the plurality of pegs, and the first one of the plurality of pegs can insert into the first notch and the second one the plurality of pegs can insert into the second notch as the back panel surface is pressed against the frame assembly, thereby attaching the panel to the frame assembly and fixing the width of the rectangular opening to the specified width.

An aspect combinable with any of the other aspects can include the following features. The system can also include a plurality of prefabricated panel sets. The panel can be a first panel, the width of the first panel can be a first panel width, and the specified width can be a first specified opening width. A first one of the plurality of prefabricated panel sets can include panels having the first panel width. A second one of the plurality of prefabricated panel sets can include panels having a second panel width. The rectangular opening can be adjusted to a second specified opening width such that the first notch is aligned with a first one of a plurality of non-metallic pegs protruding from a back panel surface of a second panel having the second panel width and the second notch is aligned with a second one of the plurality of pegs protruding from the back panel surface of the second panel, and the first one of the plurality of pegs from the second panel can insert into the first notch and the second one the plurality of pegs from the second panel can insert into the second notch as a back panel surface of the second panel is pressed against the frame assembly, thereby attaching the second panel to the frame assembly and fixing the width of the rectangular opening to the second specified width.

An aspect combinable with any of the other aspects can include the following features. The rectangular opening can be a first rectangular opening. The first frame sub-assembly further defines a second rectangular opening substantially co-planar with the first rectangular opening, the second rectangular opening having a non-adjustable width equal to the first specified opening width.

An aspect combinable with any of the other aspects can include the following features. The panel can be comprised of an unsaturated orthophthalic or isophthalic polyester resin formulated with maximum of 45% by weight of silica, about 2.5% alumina trihydrate, and between about 0.5% and 1% expanded graphite.

An aspect combinable with any of the other aspects can include the following features. The first frame sub-assembly and the second frame sub-assembly can be comprised of fiber-reinforced plastic.

An aspect combinable with any of the other aspects can include the following features. The panel and frame assembly can form part of a non-structural wall to separate spaces within a building.

An aspect combinable with any of the other aspects can include the following features. The panel can be at least partially transparent.

An aspect combinable with any of the other aspects can include the following features. The panel can be comprised of polycarbonate.

An aspect combinable with any of the other aspects can include the following features. The first panel can be at least partially transparent and the second panel can be opaque.

An aspect combinable with any of the other aspects can include the following features. The panel includes shredded rubber sandwiched between outer sheet layers.

An aspect combinable with any of the other aspects can include the following features. The pegs can be non-metallic.

An aspect combinable with any of the other aspects can include the following features. The pegs can snap-fit into the notches.

An aspect combinable with any of the other aspects can include the following features. The pegs can be cantilever snap-fit pegs.

An aspect combinable with any of the other aspects can include the following features. The panel can be removed from the frame assembly without breaking the pegs.

The details of one or more embodiments are set forth in the accompanying drawings and the description below. Other features, objects, and advantages will be apparent from the description and drawings, and from the claims.

DETAILED DESCRIPTION

In accordance with embodiments of the present disclosure, a partition system is described that can provide quick installation and cost savings. The system can include prefabricated, modular components that can be light weight and durable. The assembly provides for easy access for maintenance for pipes or electrical conduits within the partition wall, and fast and simple installation and removal.

In accordance with embodiments of the present disclosure, a "click-and-connect" system of adjustable frames and panels provides flexibility from a functional, architectural, and aesthetic perspective.

Figure 1:
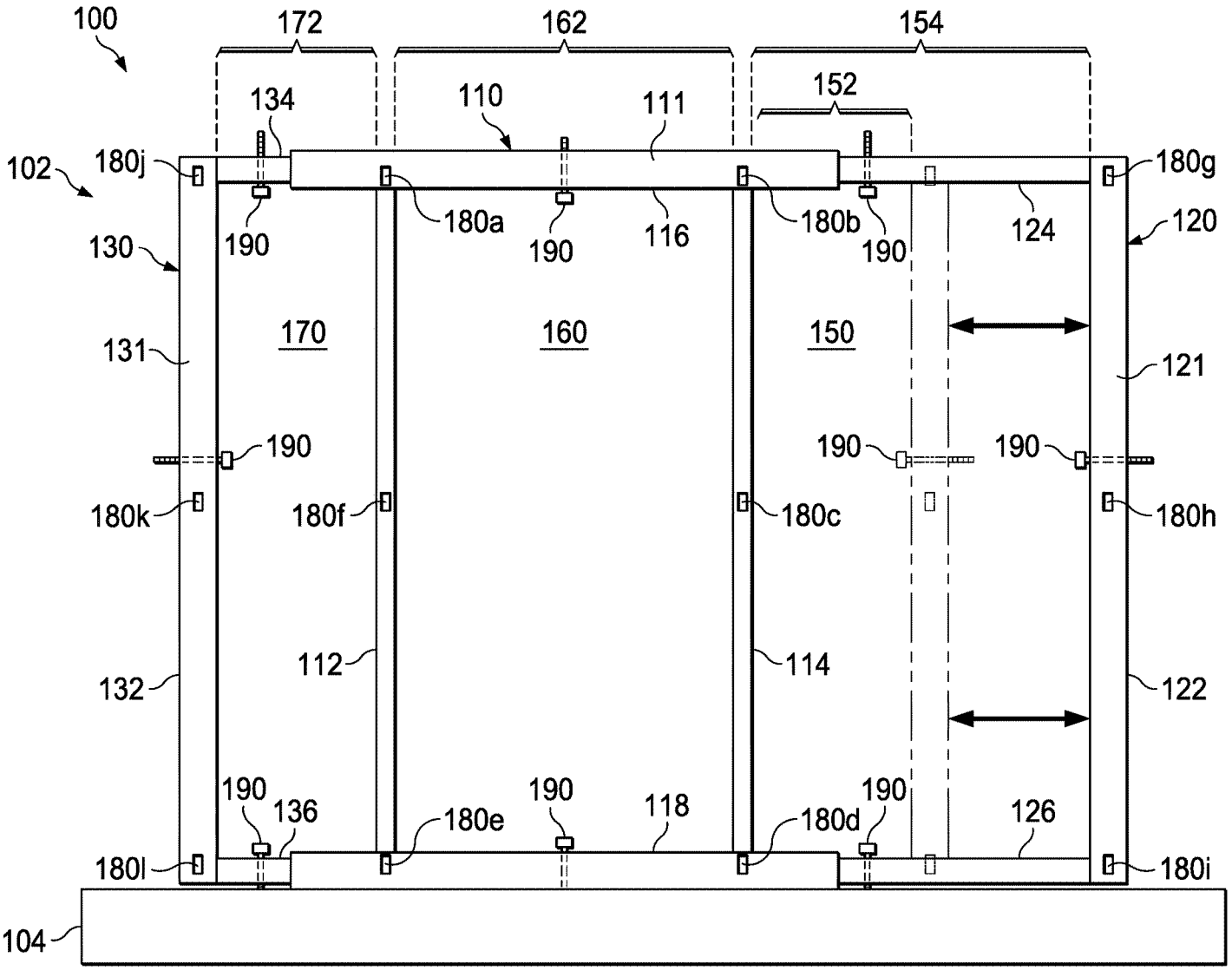
FIG. 1 is a schematic illustration of a frame assembly of a modular partition system in accordance with an embodiment of the present disclosure.

FIG. 1 is a schematic illustration of a frame assembly 102 of a modular partition system 100 in accordance with an embodiment of the present disclosure. Frame assembly 102 can in some embodiments be a partition in a room or other space within a commercial, residential, or other building. Referring to FIG. 1, a first frame sub-assembly 110 can be referred to as an "H frame" and includes vertical members 112 and 114, top horizontal member 116 and bottom horizontal member 118. Second frame sub-assembly 120 includes vertical member 122, top horizontal member 124, and bottom horizontal member 126. Third frame sub-assembly 130 includes vertical member 132, top horizontal member 134, and bottom horizontal member 136. Second frame sub-assembly 120 and third frame sub-assembly 130 can be referred to as "C frames."

A first substantially rectangular opening 150 is defined by vertical members 114 and 122, top horizontal members 116 and 124, and bottom horizontal members 118 and 126. In the illustrated embodiment, top horizontal members 116 and 124 and bottom horizontal members 118 and 126 are slidably engaged. For example, in one embodiment, horizontal members 116 and 118 can have a u-shaped cross-section sized such that horizontal members 124 and 126 fit within the u-shape and can slide in a horizontal direction. In another embodiment, horizontal members 116 and 118 are offset such that they can slide past horizontal members 124 and 126. By the horizontal members sliding within or next to each other, a width of the rectangular opening can be adjusted by sliding first frame sub-assembly 110 and second frame sub-assembly 120 together or apart. In the illustrated embodiment, two widths of rectangular opening 150 are shown: a first width 152 and second width 154.

In the illustrated embodiment, a second rectangular opening 160, substantially co-planar with rectangular opening 150, is defined by vertical members 112 and 114, top horizontal member 116, and bottom horizontal member 118. In the illustrated embodiment, second rectangular opening 160 has a non-adjustable, fixed width 162. In some embodiments, fixed width 162 can be from 1000 mm to 1500 mm. In the illustrated embodiment, width 154 is substantially equal to width 162, and width 152 is about half the width of width 162. However, it will be understood that the width of rectangular opening 150 can be adjusted to many different widths, depending on the length and extent of overlap of the horizontal members.

In the illustrated embodiment, a third substantially rectangular opening 170 is defined by vertical members 112 and 132, top horizontal members 116 and 134, and bottom horizontal members 118 and 136. In the illustrated embodiment, top horizontal members 116 and 134 and bottom horizontal members 118 and 136 are slidably engaged such that the width 172 of third rectangular opening 170 can be adjusted in a manner similar to that described above with respect to first rectangular opening 150.

Frame assembly 102 can be attached to a floor 104 using bolts 190 or another suitable attaching means. In some embodiments, bolts 190 can be metal or GFRP bolts of 5 mm×75 mm size. In some embodiments, the sides and top of frame assembly 102 can be attached to side walls and/or a ceiling, respectively, likewise using bolts 190 or another suitable attaching means.

In some embodiments, the horizontal and vertical members of the frame sub-assemblies of frame assembly 102 can be non-metallic in construction and made of a polymer material such as pultruded fiber-reinforced plastic (FRP) or extruded thermoplastic.

A front surface 111 of first sub-assembly 110 includes notches 180*a*, 180*b*, 180*c*, 180*d*, 180*e*, and 180*f*. Front surface 121 of second sub-assembly 120 includes notches 180*g*, 180*h*, and 180*i*. Front surface 131 of third sub-assembly 130 includes notches 180*j*, 180*k*, and 180*l*. Notches 180*a*-180*f* can in some embodiments be indentations or cavities as shown in more detail in reference to FIGS. 3, 4, and 5A-5C. As described in more detail in reference to the below figures, notches 180*a*-180*f* can receive pegs or other connection means attached to rectangular panels to cover rectangular openings 150, 160, and 170.

Figure 2:
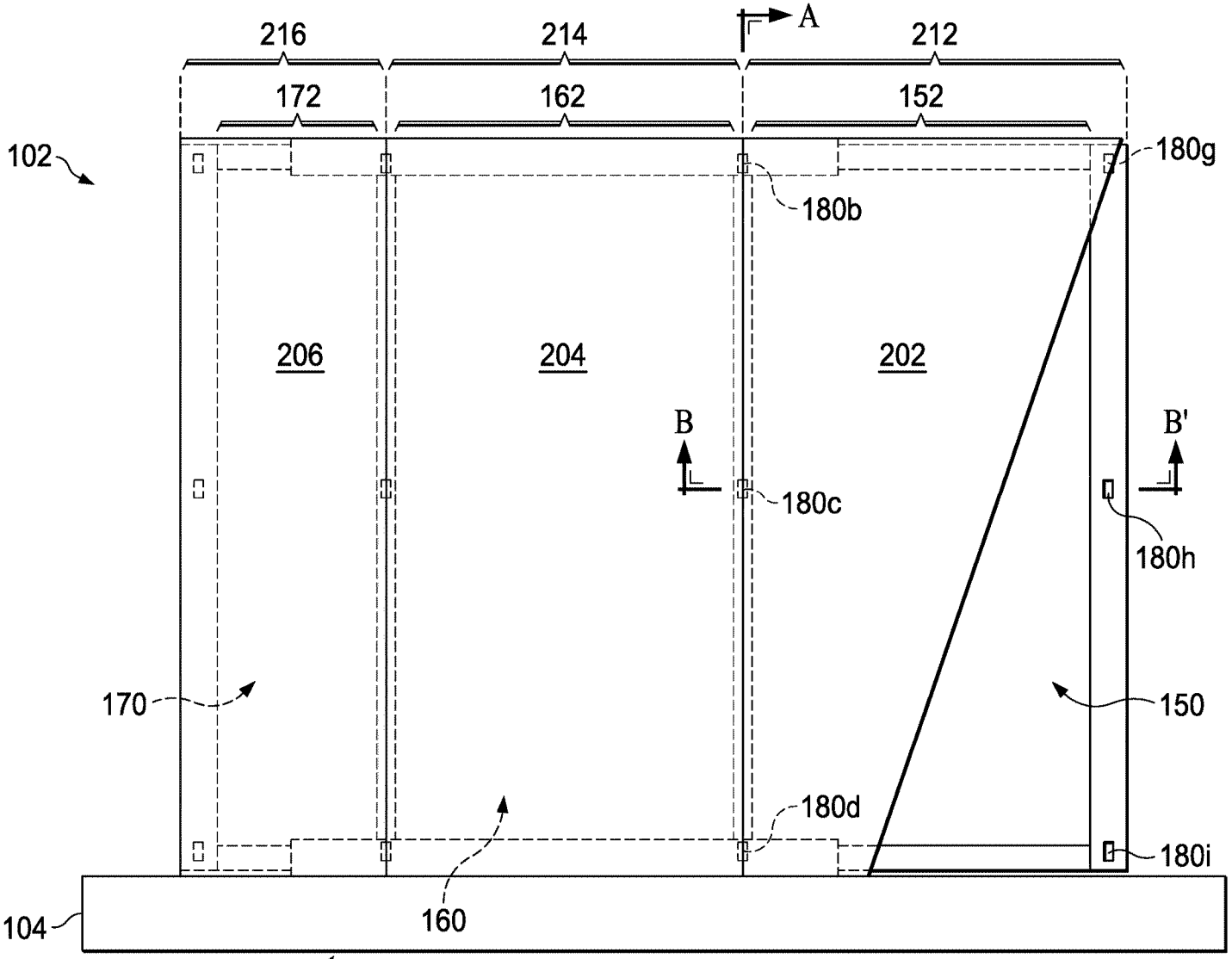
FIG. 2 is a schematic illustration of an assembled modular partition system in accordance with an embodiment of the present disclosure.
Figure 3:
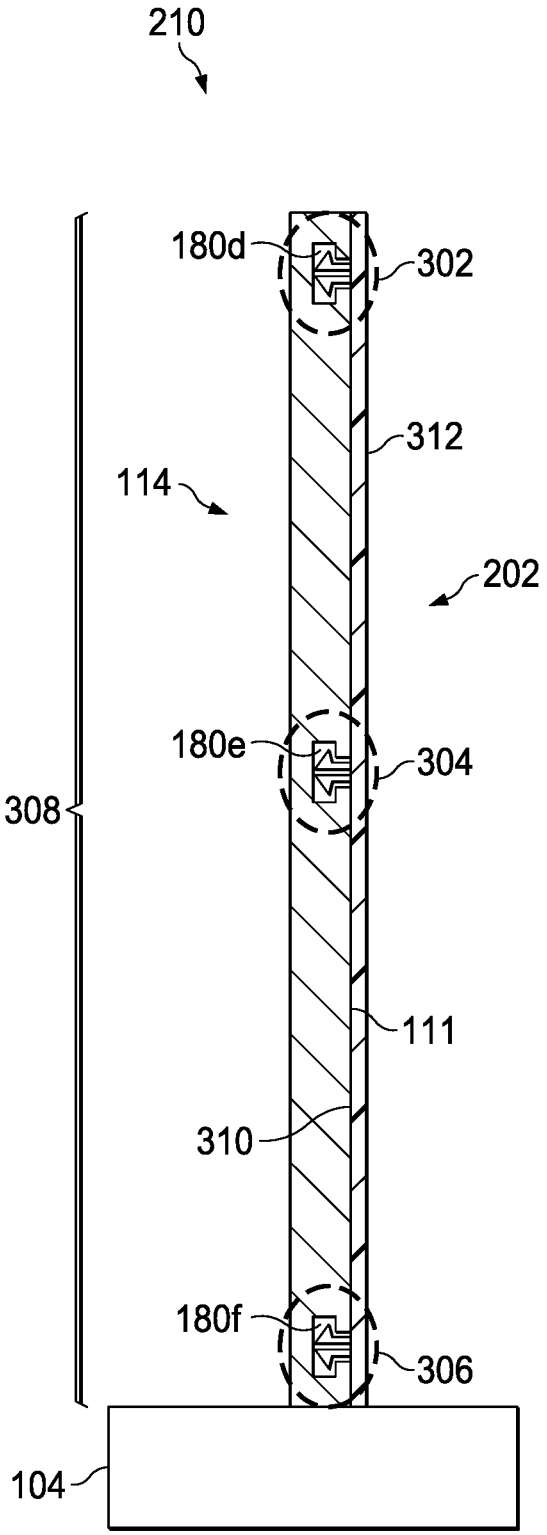
FIG. 3 is a vertical cross-sectional schematic illustration of a frame and panel assembly of the modular partition system of FIG. 2, in accordance with an embodiment of the present disclosure.
Figure 4:
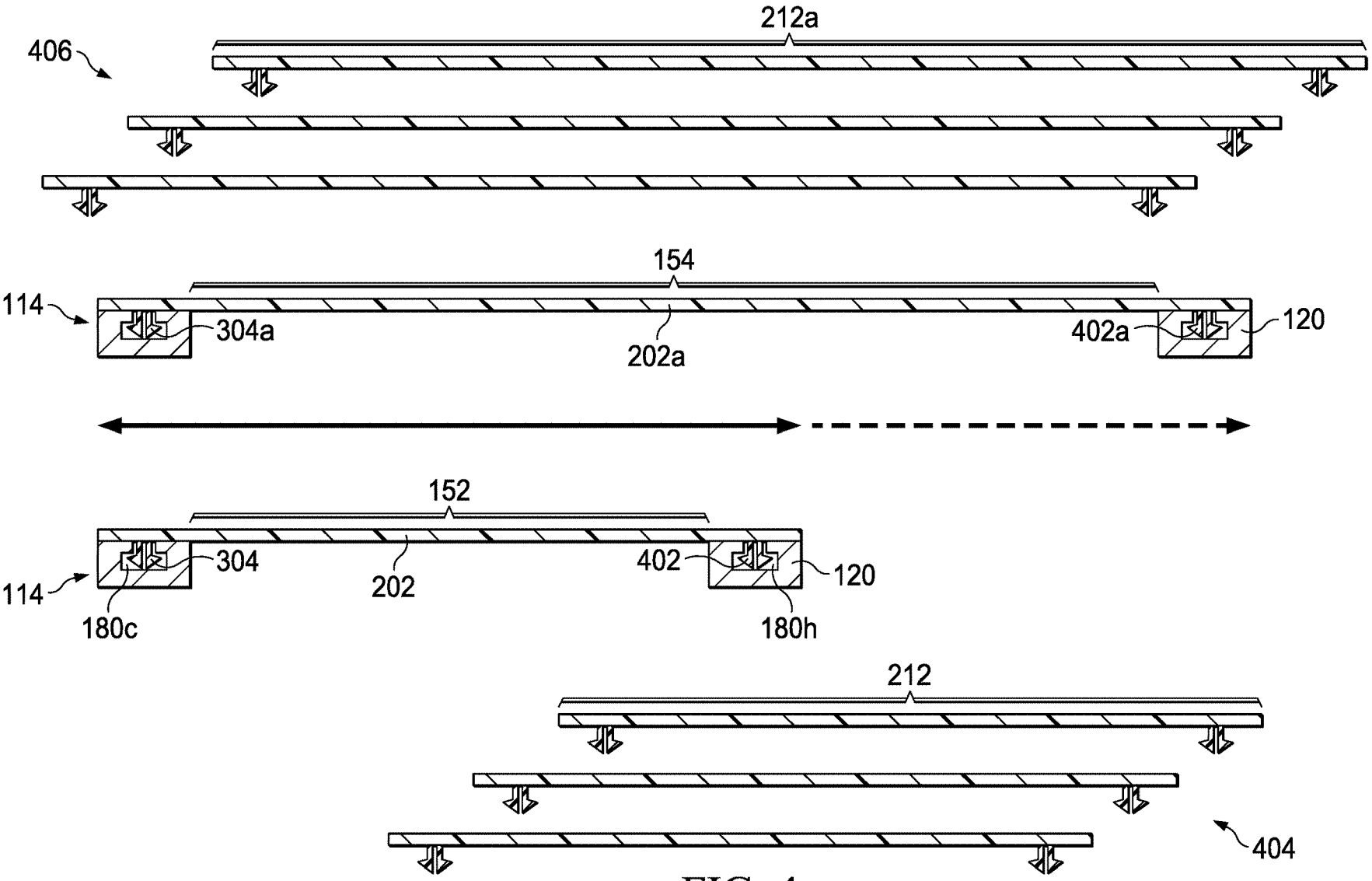
FIG. 4 is a horizontal cross-sectional schematic illustration of a frame and panel assembly of the modular partition system of FIG. 2, in accordance with an embodiment of the present disclosure.

FIG. 2 is a schematic illustration of the frame assembly 102 of FIG. 1 assembled with front panels in accordance with an embodiment of the present disclosure. FIG. 3 is a vertical cross-sectional view of the assembled frame assembly at A-A', and FIG. 4 is a horizontal cross-sectional view of the assembled assembly at B-B'. Referring to FIG. 2, rectangular panels 202, 204, and 206 are attached to the front surfaces of the frame sub-assemblies. In the illustrated embodiment, panel 202 having a width 212 covers rectangular opening 150, panel 204 having a width 214 covers opening 160, and panel 206 having a width 216 covers opening 170. Each panel 202, 204, and 206 includes pegs or other connection means protruding from a back surface of the respective panels that can insert into notches of the front surfaces of the frame sub-assemblies, thereby attaching the panels to the frame assembly. For example, as shown in FIG. 3, back panel surface 310 of panel 202 includes pegs 302, 304, and 306, which can be aligned with notches 180*b*, 180*c*, and 180*d* on front surface 111 of first frame sub-assembly 110. Each width 212, 214, and 216 can be somewhat greater than the corresponding opening widths 152, 162, and 172, respectively, such that there is some overlap with the vertical frame members and thus allowing the alignment of the pegs with the notches. For example, as shown in FIG. 4, width 212 of panel 202 is wider than rectangular opening width 152, such that panel 202 overlaps with the vertical members and notch 180*c* of vertical member 114 aligns with peg 304 of panel 202 and notch 180*h* of vertical member 120 aligns with peg 402 of panel 202. For a panel of a different width, for example panel 202*a* of FIG. 4, the frame sub-assemblies in an adjustable portion (as described above in reference to FIG. 1) can be moved together or apart so as to align with the pegs of the panel with the different width. Therefore, example, width 212*a* of panel 202*a* is wider than rectangular opening width 154, such that panel 202*a* overlaps with the vertical members and notch 180*c* of vertical member 114 aligns with peg 304*a* of panel 202*a* and notch 180*h* of vertical member 120 aligns with peg 402*a* of panel 202*a*.

In accordance with embodiments of the present disclosure, C-frame and H-frame sub-assemblies can be part of a modular system in which multiple C- and H-frame sub-assemblies are combined in a modular fashion to create rectangular openings of fixed and/or adjustable widths, such that the total width of a frame assembly (such as frame assembly 102) can be chosen or adjusted such that the frame assembly can fit within different spaces and/or to divide such spaces in different configurations, and frame openings of the same or different widths are created such that corresponding rectangular panels can be chosen as appropriate, necessary or desired for functional, architectural, or aesthetic reasons. Although the embodiments described above are wall partitions, it will be understood that other embodiments of the present disclosure can include ceiling elements constructed in accordance with the C-frame/H-frame and panel combinations described herein.

In some embodiments, the different-width panels are part of modular system including pre-fabricated panels in one or more sets of panels, each set including panels of a particular width. For example, in FIG. 4, panel 202 is a prefabricated panel from a first set 404, each panel in set 404 having width 212. Likewise, panel 202*a* is a panel from a second set 406, each panel in set 406 having width 212*a*. For example, in some embodiments, width 212 is can be a width of between 300 to 500 mm and width 212*a* can be a width of between 1000 and 1500 mm. Panel height (for example, height 308 of FIG. 3) can in some embodiments be from 1800 to 2000 mm. In some embodiments, panels from sets 404 and 406 can have thicknesses of from 5 to 10 mm. In other embodiments the panels can have a greater or lesser thickness.

Figure 5C:
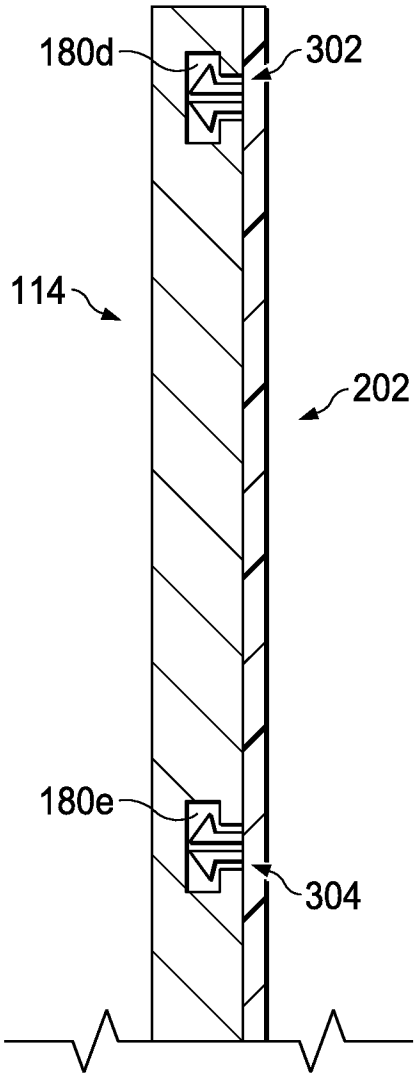
FIGS. 5A-5C is a schematic illustration of attachment of a panel to the front of a frame assembly of the modular partition system in accordance with an embodiment of the present disclosure.
Figure 5B:
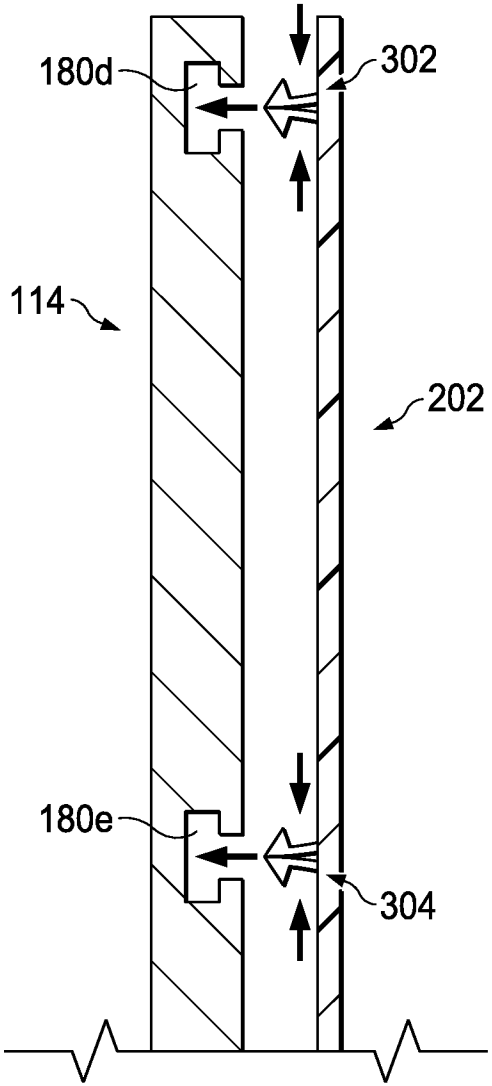
Figure 5A:
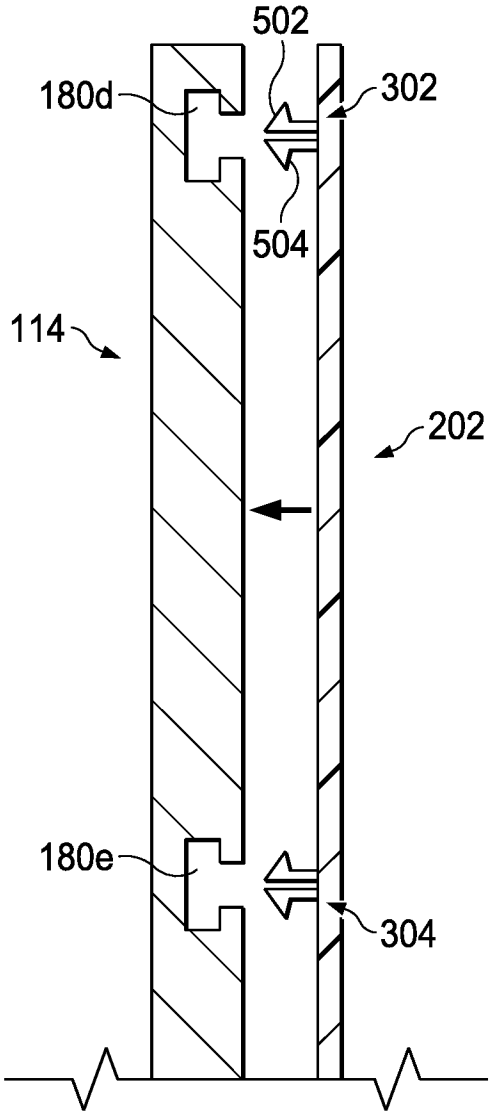

As shown in FIGS. 5A-5C, in some embodiments the pegs of the panels snap-fit into the corresponding notches. In this way, the panels and frames form a "click-and-connect" system whereby the panels can be easily attached and removed from the frames. As shown in FIG. 5A, the pegs 302 and 304 of panel 202 are aligned with notches 180*d* and 180*e*, respectively, of frame member 114. In some embodiments, the pegs are cantilever snap-fit pegs divided into two halves. The tip of each half can in some embodiments have a tapered entrance angle 502, such that the halves squeeze together upon being pushed into the notches for easy insertion into the notches (FIG. 5B). Once inserted into the notches, the halves expand outward in cantilever fashion, locking the pegs into the notches and firmly attaching panel 202 to frame member 114. In some embodiments, the tips of the pegs have tapered exit angles 504 such that, if it is desired to remove a panel from the frame, a sufficient pulling force applied to the panel will cause the halves of the pegs to squeeze together, allowing removal of the panel from the frame without breaking the pegs. In some embodiments, the exit angle is steeper than the entrance angle such that a greater force is required to remove the panel than to attach the panel. In some embodiments, other kinds of snap-fit or other removable or non-removable connection means can be used to attach the panels to the frame assemblies.

In some embodiments, the rectangular panels (or sets of rectangular panels) can have different compositions, finishes, and other characteristics. For example, in some embodiments, one or more of the rectangular panels of a partition system can be non-metallic and constructed of a lightweight polymer based plastic. In some embodiments, one or more of the panels of a partition system can be or transparent or semi-transparent and made of, for example, polycarbonate. In some embodiments, a partition system can mix opaque and transparent components, i.e., can include one or more panels which are opaque and one or more panels which are transparent. The materials can be thermoplastic or thermosetting and can be either reinforced or unreinforced as required for the application. In some embodiments, a modular system can include multiple sets of prefabricated panels of different sizes, compositions, and other characteristics.

In some embodiments, the panels and/or frame elements can be optimized for fire rating performance to slow down combustion and degradation, reduce smoke emission, and avoid material dripping. Additionally, materials can be optimized to enhance noise reduction and fungus formation in presence of humidity. For example, the components can be composed of an FRP material comprising an unsaturated polyester resin (such as an orthophthalic or isophthalic resin) formulated with a maximum of 45% w/w/silica (sand), 2.5% alumina trihydrate (ATH) and 0.5-1% expanded graphite for optimum fire retardancy properties In some embodiments, the components can be composed of a thermoplastic and/or polyolefins such as polypropylene (PP) or HDPE, adding a dosage of 20-25% by weight of oligomeric char-forming agent additives (CNCA-DA), in combination with Ammonium polyphosphate (APP). This can be added during melt mixing during the extrusion process to make the sheet panels. The final effect of the fire retardant agent is to change the decomposition behavior of the polyolefin (PP, Pe or HDPE) and form a char layer on the surface of the panel, resulting in a net reduction of the key flammability factors such as heat release rate (HRR) and smoke production rate.

In some embodiments, the panels and/or vertical and horizontal frame members can be optimized for noise reduction. For example, in some embodiments, the panels can be a sandwich structure of a hollow core bounded by front and back FRP sheet layers, with the hollow core filled with ground material such as recycled rubber from scrap tires, recycled EPDM or polyurethane. Polymers, binder agents, and adhesion improvers can be included as necessary.

The ratio and proportion of additive, and fillers above can be modified to meet specific fire rating and/or noise reduction requirements of particular countries or local or international building code.

Figure 6:
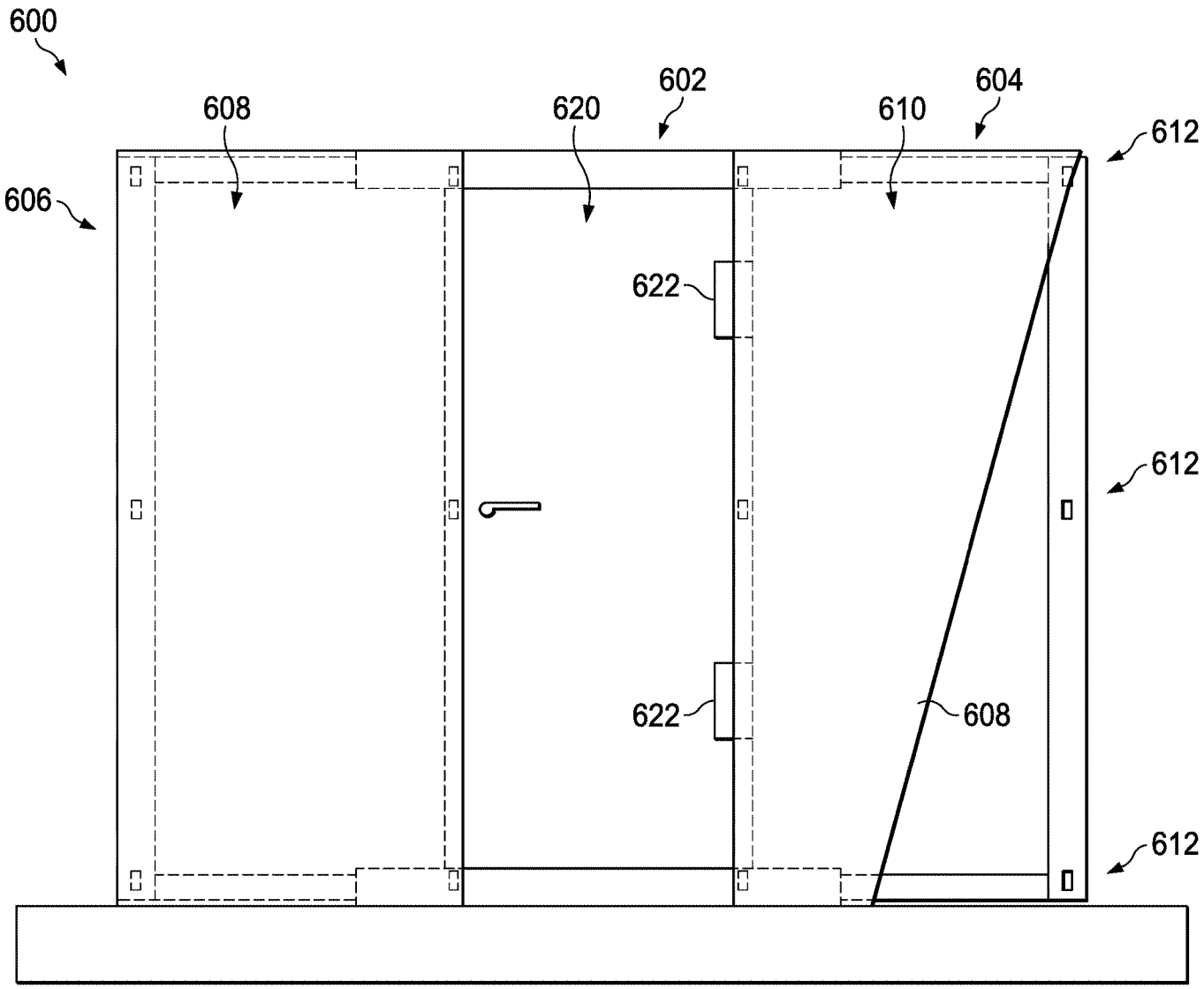
FIG. 6 is a schematic illustration of an assembled modular partition system including a doorway in accordance with an embodiment of the present disclosure.

In some embodiments, other functional or architectural components such as doors and windows can be included in a partition system addition to the frame-and-panel combinations described above. For example, FIG. 6 shows a modular system 600 comprising frame subassemblies 602, 604, and 606 which can be H- and (adjustable-width) C-frame subassemblies similar to subassemblies 110, 120 and 130 as described in reference to FIG. 1, and panels 608 and 610 which can be modular panels with pegs for a snap-fit attachment into notches 612 similar to panels 202 and 204 with pegs snap-fitting into notches 180*a*-1 as described in reference to FIG. 2. As described above, in some embodiments, one or more of the panels 608 and 610 can be or transparent, semi-transparent, and/or opaque. Door 620 is attached to a vertical frame member of frame subassembly 602 with hinges 622. As shown in this example, the modular partition system provides flexibility for various architectural and/or structural building designs including doors, windows, decorative openings, and other functional and/or aesthetic features.

While this specification contains many specific implementation details, these should not be construed as limitations on the scope of any claims or of what may be claimed, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable sub-combination. Moreover, although features may be described as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A modular partition system, comprising, a non-metallic polymer frame assembly forming a substantially rectangular opening defined by:

a vertical member of a first frame sub-assembly;

a vertical member of a second frame sub-assembly;

a top horizontal member of the first frame sub-assembly;

a bottom horizontal member of the first frame sub-assembly;

a top horizontal member of the second frame sub-assembly; and a bottom horizontal member of the second frame sub-assembly, wherein the top horizontal member of the first frame sub-assembly and the bottom horizontal member of the first frame subassembly are slidably engaged with the top horizontal member of the second frame sub-assembly and the bottom horizontal member of the second frame sub-assembly, respectively, such that a width of the rectangular opening is adjustable by sliding the first frame sub-assembly and the second frame sub-assembly together or apart;

a first notch in a front surface of the first frame sub-assembly;

a second notch in a front surface of the second frame sub-assembly;

a non-metallic rectangular polymer panel comprising a front panel surface and a back panel surface, the panel comprised of an unsaturated orthophthalic or isophthalic polyester resin formulated with maximum of 45% by weight of silica, about 2.5% alumina trihydrate, and between about 0.5% and 1% expanded graphite; and a plurality of non-metallic pegs protruding from the back panel surface and configured such that, if the width of the rectangular opening is adjusted to a specified width, the first notch is aligned with a first one of the plurality of pegs and the second notch is aligned with a second one of the plurality of pegs, and the first one of the plurality of pegs inserts into the first notch and the second one the plurality of pegs inserts into the second notch as the back panel surface is pressed against the frame assembly, thereby attaching the panel to the frame assembly and fixing the width of the rectangular opening to the specified width.

2. The modular partition system of claim 1, further comprising a plurality of prefabricated panel sets, and wherein;

the panel is a first panel, the width of the first panel is a first panel width, and the specified width is a first specified opening width;

a first one of the plurality of prefabricated panel sets comprises panels having the first panel width;

a second one of the plurality of prefabricated panel sets comprises panels having a second panel width; and the rectangular opening can be adjusted to a second specified opening width such that the first notch is aligned with a first one of a plurality of non-metallic pegs protruding from a back panel surface of a second panel having the second panel width and the second notch is aligned with a second one of the plurality of pegs protruding from the back panel surface of the second panel, and the first one of the plurality of pegs from the second panel inserts into the first notch and the second one the plurality of pegs from the second panel inserts into the second notch as a back panel surface of the second panel is pressed against the frame assembly, thereby attaching the second panel to the frame assembly and fixing the width of the rectangular opening to the second specified width.

3. The modular partition system of claim 2, wherein the rectangular opening is a first rectangular opening and wherein the first frame sub-assembly further defines a second rectangular opening substantially co-planar with the first rectangular opening, the second rectangular opening having a non-adjustable width equal to the first specified opening width.

4. The modular partition system of claim 2, wherein the first panel is at least partially transparent and the second panel is opaque.

5. The modular partition system of claim 1, wherein the first frame sub-assembly and the second frame sub-assembly are comprised of fiber-reinforced plastic.

6. The modular partition system of claim 1, wherein the panel and frame assembly forms part of a non-structural wall to separate spaces within a building.

7. The modular partition system of claim 1, wherein the panel is at least partially transparent.

8. The modular partition system of claim 7, wherein the panel is comprised of polycarbonate.

9. The modular partition system of claim 1, wherein the panel comprises shredded rubber sandwiched between outer sheet layers.

10. The modular partition system of claim 1, wherein the pegs are non-metallic.

11. The modular partition system of claim 1, wherein the pegs snap-fit into the notches.

12. The modular partition system of claim 11, wherein the pegs are cantilever snap-fit pegs.

13. The modular partition system of claim 11, wherein the panel can be removed from the frame assembly without breaking the pegs.

* * * * *